US011378026B2

(12) United States Patent
Harshe et al.

(10) Patent No.: US 11,378,026 B2
(45) Date of Patent: Jul. 5, 2022

(54) SELF-LEARNING TORQUE OVER BOOST COMBUSTION CONTROL

(71) Applicant: Cummins Inc., Columbus, IN (US)

(72) Inventors: Omkar A. Harshe, Columbus, IN (US); Ming-Feng Hsieh, Nashville, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 17/227,833

(22) Filed: Apr. 12, 2021

(65) Prior Publication Data

US 2021/0231064 A1 Jul. 29, 2021

Related U.S. Application Data

(63) Continuation of application No. PCT/US2019/060887, filed on Nov. 12, 2019.
(Continued)

(51) Int. Cl.
*F02D 41/00* (2006.01)
*F02B 37/18* (2006.01)
*F02D 41/14* (2006.01)

(52) U.S. Cl.
CPC ..... *F02D 41/0007* (2013.01); *F02B 37/18* (2013.01); *F02D 41/0027* (2013.01);
(Continued)

(58) Field of Classification Search
CPC ..... F02D 41/0007; F02D 41/0027; F02D 41/0052; F02D 41/1402; F02D 41/1448; F02D 41/1461; F02D 2250/36; F02D 41/1497; F02D 2200/0414; F02D 2200/1002; F02D 35/027; F02D 41/2451;
(Continued)

(56) References Cited

U.S. PATENT DOCUMENTS 8,468,824 B2 * 6/2013 Schaffeld ..... F02B 33/446 60/611
8,484,971 B2 * 7/2013 Schaffeld ..... F02B 37/12 60/611
(Continued)

FOREIGN PATENT DOCUMENTS

WO 2017207463 A1 12/2017

OTHER PUBLICATIONS

Search Report and Written Opinion, counter PCT Appln. No. PCT/US19/60887, dated Jan. 27, 2020, 8 pgs.

*Primary Examiner* — Joseph J Dallo
(74) *Attorney, Agent, or Firm* — Taft Stettinius & Hollister LLP

(57) ABSTRACT

A spark ignited internal combustion engine is controlled in response to a self-learned TOB reference. The self-learned TOB reference is based on a difference between a learned TOB offset and a desired or target TOB, and a sensed TOB. The learned TOB offset at a given operating condition, such as charge pressure, can be found by interpolating between the learned charge pressure breakpoints in a TOB learning algorithm. The TOB learning algorithm can include using a filtered charge pressure value to indicate the engine load at which the TOB is learned. An index determination is made with a look up table with charge pressure as an input and an array index of learned charge pressure and learned TOB offset as outputs.

20 Claims, 2 Drawing Sheets

Related U.S. Application Data

(60) Provisional application No. 62/769,302, filed on Nov. 19, 2018.

(52) U.S. Cl.
CPC ..... *F02D 41/0052* (2013.01); *F02D 41/1402* (2013.01); *F02D 41/1448* (2013.01); *F02D 41/1461* (2013.01); *F02D 2250/36* (2013.01)

(58) Field of Classification Search
CPC ..... F02D 41/222; F02B 37/18; F02P 5/1516; F02M 26/01; F02M 26/02; Y02T 10/12; Y02T 10/40
See application file for complete search history.

(56) References Cited

U.S. PATENT DOCUMENTS 8,505,297 B2 * 8/2013 Schaffeld ..... F02B 21/00 60/611
8,534,065 B2 * 9/2013 Pursifull ..... F02B 21/00 60/611
8,700,291 B2 4/2014 Herrmann
8,931,273 B2 * 1/2015 Rollinger ..... F02P 5/1504 60/611
9,267,426 B2 * 2/2016 Makino ..... F02D 41/0007
9,284,880 B2 * 3/2016 Glugla ..... F02M 25/028
9,518,521 B2 * 12/2016 Lavertu ..... F02D 41/2487
9,546,593 B2 * 1/2017 Marx ..... F02D 23/00
9,816,435 B2 * 11/2017 Granstrom ..... F02B 37/16
9,855,939 B2 * 1/2018 Jordan ..... B60T 15/041
9,868,089 B2 * 1/2018 Lavertu ..... F01N 3/021
9,926,867 B1 * 3/2018 Schum ..... F02M 26/10
9,937,773 B2 * 4/2018 Jung ..... B60H 1/3208
9,957,901 B2 * 5/2018 Nagar ..... F02D 41/0007
10,161,345 B2 * 12/2018 Sharma ..... F02B 75/02
10,247,146 B2 * 4/2019 Hashimoto ..... F02M 26/53
10,252,607 B2 * 4/2019 Wang ..... B60T 1/062
10,315,638 B2 * 6/2019 Dekam ..... B60T 17/02
10,337,421 B2 * 7/2019 Hirose ..... F01N 13/10
10,526,957 B2 * 1/2020 Aoyagi ..... F02B 37/186
10,626,809 B2 * 4/2020 Hirose ..... F02D 41/0025
10,920,687 B2 * 2/2021 Hsieh ..... F02P 5/145
2009/0287392 A1 11/2009 Thomas
2010/0300069 A1 12/2010 Herrmann et al.
2012/0221223 A1 8/2012 Schaffeld et al.
2014/0102092 A1 4/2014 Kamik et al.
2017/0335753 A1 11/2017 Xiao et al.
2018/0112616 A1 4/2018 Wang et al.
2018/0135541 A1 * 5/2018 Hsieh ..... F02P 5/145
2021/0079858 A1 * 3/2021 Hsieh ..... F02B 37/16

* cited by examiner

SELF-LEARNING TORQUE OVER BOOST COMBUSTION CONTROL

CROSS-REFERENCE TO RELATED APPLICATION

The present application is a continuation of International Patent Application No. PCT/US19/60887 filed on Nov. 12, 2019, which claims the benefit of the filing date of U.S. Provisional Application Ser. No. 62/769,302 filed on Nov. 19, 2018, which are incorporated herein by reference.

FIELD OF THE INVENTION

The present invention relates generally to combustion control for an internal combustion engine, and more particularly is concerned with combustion control of the engine using a self-learned torque over boost (TOB) reference.

BACKGROUND

A spark ignited engine can employ NOx feedback in a control algorithm, such as in a flame speed compensator algorithm, to determine combustion parameters such as spark timing and/or air-fuel ratio (AFR) in the engine cylinders. Typically a physical NOx sensor that measures engine-out NOx is used on most applications. However, for certain applications and/or operating conditions, a NOx sensor has a very short useful life and is not recommended or desirable for use, or has failed or is not reliable or active and cannot be used for combustion control.

One alternative method to employing a physical NOx sensor involves determining NOx with a "virtual" NOx sensor. One virtual NOx sensor technique involves a torque over boost (TOB) determination for NOx estimation. One example of TOB NOx estimation is provided in U.S. Pat. No. 5,949,146, which is incorporated herein by reference.

TOB is determined by the brake mean effective pressure (BMEP) (or torque output or braking power of the engine) times the ratio of the intake manifold temperature (IMT) to the intake manifold pressure (IMP). However, TOB NOx estimation may not provide the desired accuracy or robustness for the control system to provide the desired system performance. For example, TOB can vary based on varying operating conditions and particular individual engines, which creates challenges for calibration development and engine commission. Thus, there remains a need for additional improvements in systems and methods for NOx estimation and in the control of spark ignited engine operations.

SUMMARY

Unique systems, methods and apparatus are disclosed for controlling operation of a spark ignited internal combustion in response to a self-learned TOB reference. In one embodiment, a spark ignited internal combustion engine is controlled in response to a self-learned TOB reference. The self-learned TOB reference is based on a difference between a learned TOB offset and a desired TOB from a sensed or target TOB. The learned TOB offset at a given operating condition, such as charge pressure, can be found by interpolating between the learned charge pressure breakpoints in the TOB learning algorithm.

In a further embodiment, the TOB learning algorithm can include using a filtered charge pressure value to indicate the engine load at which the TOB offset (the difference between the desired TOB and sensed TOB) is learned. An index determination is made using a look up table with charge pressure as an input and an array index of learned charge pressure and associated learned TOB offset as outputs to the combustion control algorithm.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

DESCRIPTION OF ILLUSTRATIVE EMBODIMENTS

Figure 1:
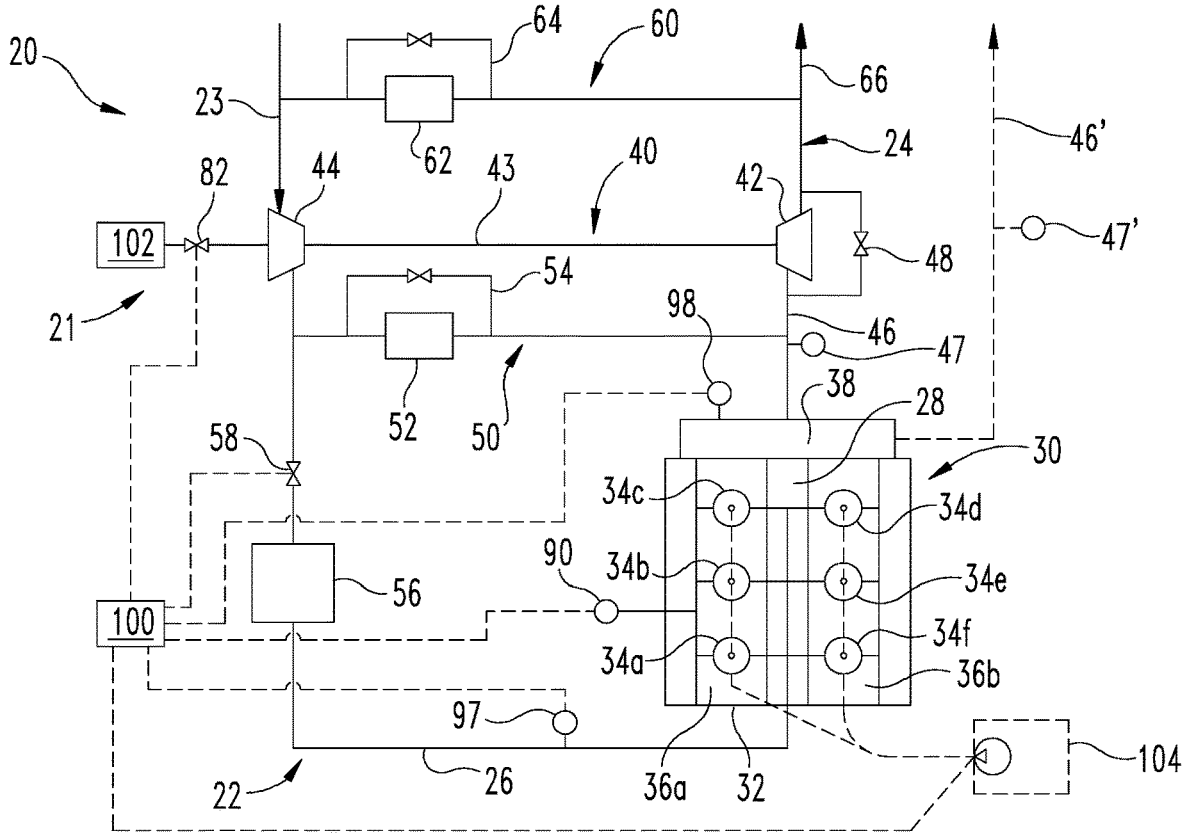
FIG. 1 is a schematic illustration of a portion of an internal combustion engine system with a charge pressure sensor.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

With reference to FIG. 1, an internal combustion engine system 20 is illustrated in schematic form. A fueling system 21 is also shown in schematic form that is operable with internal combustion engine system 20 to provide fueling for engine 30 from a first fuel source 102. In one embodiment, only one fuel source 102 is provided and fuel source 102 is located so that the fuel is pre-mixed with the charge flow upstream of the combustion chambers of engine cylinders 34. In another embodiment, the fuel from first fuel source 102 is injected directly into the cylinder(s) via direct injection or via port injection. In yet another embodiment, fueling system 21 includes an optional second fuel source 104 for also providing fueling, and internal combustion engine system 20 is a dual fuel system.

Internal combustion engine system 20 includes engine 30 connected with an intake system 22 for providing a charge flow to engine 30 and an exhaust system 24 for output of exhaust gases in an exhaust flow. In certain embodiments, the engine 30 includes a spark ignited internal combustion engine in which a gaseous fuel flow is pre-mixed with the charge flow from first fuel source 102. The gaseous fuel can be, for example, natural gas, bio-gas, methane, propane, ethanol, producer gas, field gas, liquefied natural gas, compressed natural gas, or landfill gas.

In another embodiment, engine 30 includes a lean combustion engine such as a diesel cycle engine that uses a liquid fuel in second fuel source 104 such as diesel fuel as the sole fuel source, or in combination with a gaseous fuel in first fuel source 102 such as natural gas. However, other types of liquid and gaseous fuels are not precluded, such as any suitable liquid fuel and gaseous fuel. In the illustrated embodiment, the engine 30 includes six cylinders 34*a*-34*f* in a two cylinder bank 36*a*, 36*b* arrangement. However, the number of cylinders (collectively referred to as cylinders 34) may be any number, and the arrangement of cylinders 34 unless noted otherwise may be any arrangement including an in-line arrangement, and is not limited to the number and arrangement shown in FIG. 1.

Engine 30 includes an engine block 32 that at least partially defines the cylinders 34. A plurality of pistons, such as piston 70 shown in FIG. 2, may be slidably disposed within respective cylinders 34 to reciprocate between a top-dead-center position and a bottom-dead-center position while rotating a crankshaft 78. Each of the cylinders 34, its respective piston 70, and the cylinder head 72 form a combustion chamber 74. One or more intake valves, such an intake valve 92, and one or more exhaust valves, such as exhaust valve 94, are moved between open and closed positions by a conventional valve control system, cam phaser, or a variable valve timing system, to control the flow of intake air or air/fuel mixture into, and exhaust gases out of, the cylinder 34, respectively.

Figure 2:
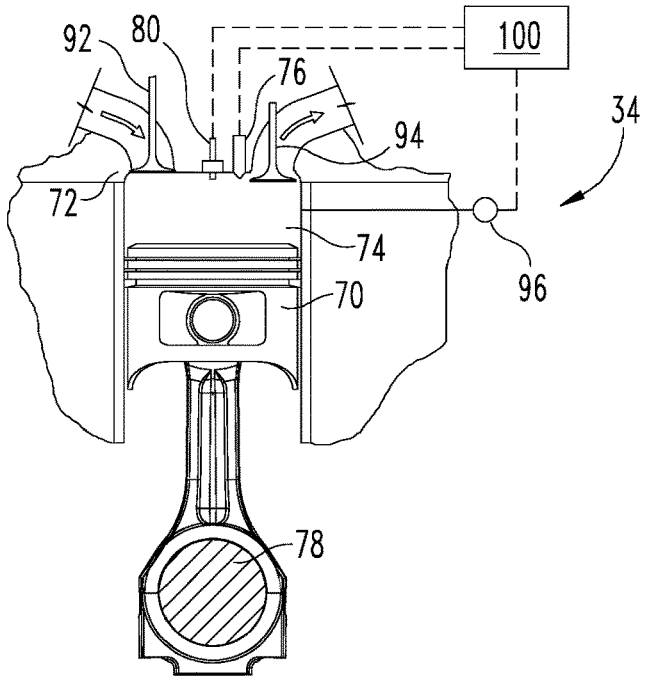
FIG. 2 is a schematic illustration of a cylinder of the internal combustion engine system of FIG. 1.

FIG. 2 shows a single engine cylinder 34 of the multi-cylinder reciprocating piston type engine shown in FIG. 1. The control system of the present invention could be used to control fuel delivery and combustion in an engine having only a single cylinder or any number of cylinders, for example, a four, six, eight or twelve cylinder or more internal combustion engine. In addition, control system may be adapted for use on any internal combustion engine having compression, combustion and expansion events, including a rotary engine, two stroke cycle engines, four stroke cycle engines, N stroke cycle engines, HCCI engine, PCCI engines, and a free piston engine. In other embodiments system 20 includes a motor/generator and an energy storage system configured to provide hybrid operations in which power is selectively provided by the engine, the energy storage system and motor/generator, and combinations of these. The control system of the present invention may also be employed with any suitable ignition system, including spark plug 80, diesel pilot ignition, plasma, laser, passive or fuel fed pre-chamber, and integrated pre-chamber spark plug ignition systems, for example.

The control system may further include a cylinder sensor 96 for sensing or detecting an engine operating condition indicative of the combustion in combustion chamber 74 and generating a corresponding output signal to controller 100. Cylinder sensor 96 permits effective combustion control capability by detecting an engine operating condition or parameter directly related to, or indicative of, the combustion event in cylinder 34 during the compression and/or expansion strokes. For example, cylinder sensor 96 can measure cylinder pressure (average or peak), charge pressure, knock intensity, start of combustion, combustion rate, combustion duration, crank angle at which peak cylinder pressure occurs, combustion event or heat release placement, effective expansion ratio, a parameter indicative of a centroid of heat release placement, location and start/end of combustion processes, lambda, and/or an oxygen amount.

In one embodiment, engine 30 is a four stroke engine. That is, for each complete engine combustion cycle (i.e., for every two full crankshaft 78 rotations), each piston 74 of each cylinder 34 moves through an intake stroke, a compression stroke, a combustion or power stroke, and an exhaust stroke. Thus, during each complete combustion cycle for the depicted six cylinder engine, there are six strokes during which air is drawn into individual combustion chambers 74 from intake supply conduit 26 and six strokes during which exhaust gas is supplied to exhaust manifold 38. As discussed further below, the present invention measures an exhaust manifold pressure with at least one exhaust manifold pressure sensor 98 at one or more locations in exhaust manifold 38 and determines an estimate of the NOx output from the one or more cylinders 34 based at least in part on the exhaust manifold pressure.

The engine 30 includes cylinders 34 connected to the intake system 22 to receive a charge flow and connected to exhaust system 24 to release exhaust gases produced by combustion of the fuel(s). Exhaust system 24 may provide exhaust gases to a turbocharger 40 (or multiple turbochargers in a single stage), although a turbocharger is not required. In still other embodiments, multiple turbochargers are included to provide high pressure and low pressure turbocharging stages that compress the intake flow.

Furthermore, exhaust system 24 can be connected to intake system 22 with one or both of a high pressure exhaust gas recirculation (EGR) system 50 and a low pressure EGR system 60. EGR systems 50, 60 may include a cooler 52, 62 and bypass 54, 64, respectively. In other embodiments, one or both of EGR systems 50, 60 are not provided. When provided, EGR system(s) 50, 60 provide exhaust gas recirculation to engine 30 in certain operating conditions. In any EGR arrangement during at least certain operating conditions, at least a portion the exhaust output of cylinder(s) 34 is recirculated to the engine intake system 22.

In the high pressure EGR system 50, the exhaust gas from the cylinder(s) 34 takes off from exhaust system 24 upstream of turbine 42 of turbocharger 40 and combines with intake flow at a position downstream of compressor 44 of turbocharger 40 and upstream of an intake manifold 28 of engine 30. In the low pressure EGR system 60, the exhaust gas from the cylinder(s) 34*a*-34*f* takes off from exhaust system 24 downstream of turbine 42 of turbocharger 40 and combines with intake flow at a position upstream of compressor 44 of turbocharger 40. The recirculated exhaust gas may combine with the intake gases in a mixer (not shown) of intake system 22 or by any other arrangement. In certain embodiments, the recirculated exhaust gas returns to the intake manifold 28 directly. In yet another embodiment, the system 20 includes a dedicated EGR loop in which exhaust gas from one or more, but less than all, of cylinders 34 is dedicated solely to EGR flow during at least some operating conditions.

Intake system 22 includes one or more inlet supply conduits 26 connected to an engine intake manifold 28, which distributes the charge flow to cylinders 34 of engine 30. Exhaust system 24 is also coupled to engine 30 with engine exhaust manifold 38. Exhaust system 24 includes at least one exhaust conduit 46 extending from exhaust manifold 32 to an exhaust valve. In the illustrated embodiment, exhaust conduit 46 extends to turbine 42 of turbocharger 40. Turbine 42 may include a valve such as controllable waste gate 48 or other suitable bypass that is operable to selectively bypass at least a portion of the exhaust flow from turbine 42 to reduce boost pressure and engine torque under certain operating conditions. In another embodiment, turbine 42 is a variable geometry turbine with a size-controllable inlet opening. In another embodiment, the exhaust valve is an exhaust throttle that can be closed or opened. Turbocharger 40 may also include multiple turbochargers.

Turbine 42 is connected via a shaft 43 to compressor 44 that is flow coupled to inlet supply conduit 26.

In yet another embodiment, the exhaust system 24 includes exhaust conduit 46 connected with one of the banks 36*a* of cylinders 34 (e.g. cylinders 34*a*-34*c*) and another, second exhaust conduit 46' connected to the other of the banks 36*b* of cylinders 34 (e.g. cylinders 34*d*-34*f*.) The exhaust conduits 46, 46' may each include an exhaust sensor 47, 47' that measures engine-out NOx. Engine out NOx or an average knock index may be used as feedback control of the engine 30 in a closed loop combustion control algorithm, such as for flame speed compensation.

An aftertreatment system (not shown) can be connected with an outlet conduit 66. The aftertreatment system may include, for example, oxidation devices (DOC), particulate removing devices (PF, DPF, CDPF), constituent absorbers or reducers (SCR, AMOX, LNT), reductant systems, and other components if desired. In one embodiment, exhaust conduit 46 is flow coupled to exhaust manifold 32, and may also include one or more intermediate flow passages, conduits or other structures. Exhaust conduit 46 extends to turbine 42 of turbocharger 40. A second turbocharger may be provided if a second exhaust conduit 46' is included with system 20.

Compressor 44 receives fresh air flow from intake air supply conduit 23. Fuel source 102 may also be flow coupled at or upstream of the inlet to compressor 44 which provides a pre-mixed charge flow to cylinders 34. Intake system 22 may further include a compressor bypass (not shown) that connects a downstream or outlet side of compressor 44 to an upstream or inlet side of compressor 44. Inlet supply conduit 26 may include a charge air cooler 56 downstream from compressor 44 and intake throttle 58. In another embodiment, a charge air cooler 56 is located in the intake system 22 upstream of intake throttle 58. Charge air cooler 56 may be disposed within inlet air supply conduit 26 between engine 30 and compressor 44, and embody, for example, an air-to-air heat exchanger, an air-to-liquid heat exchanger, or a combination of both to facilitate the transfer of thermal energy to or from the flow directed to engine 30.

In operation of internal combustion engine system 20, fresh air is supplied through inlet air supply conduit 23. The fresh air flow or combined flows can be filtered, unfiltered, and/or conditioned in any known manner, either before or after mixing with the EGR flow from EGR systems 50, 60 when provided. The intake system 22 may include components configured to facilitate or control introduction of the charge flow to engine 30, and may include intake throttle 58, one or more compressors 44, and charge air cooler 56. The intake throttle 58 may be connected upstream or downstream of compressor 44 via a fluid passage and configured to regulate a flow of atmospheric air and/or combined air/EGR flow to engine 30. Compressor 44 may be a fixed or variable geometry compressor configured to receive air or air and fuel mixture from fuel source 102 and compress the air or combined flow to a predetermined pressure level before engine 30. The charge flow is pressurized with compressor 44 and sent through charge air cooler 56 and supplied to engine 30 through intake supply conduit 26 to engine intake manifold 28.

Fuel system 21 is configured to provide either fueling from a single fuel source, such as first fuel source 102 or second fuel source 104. In another embodiment, dual fueling of engine 30 from both of fuel sources 102, 104 is provided. In one dual fuel embodiment, fuel system 21 includes first fuel source 102 and second fuel source 104. First fuel source 102 is connected to intake system 22 with a mixer or connection at or adjacent an inlet of compressor 44. Second fuel source 104 is configured to provide a flow of liquid fuel to cylinders 34 with one or more injectors at or near each cylinder. In certain embodiments, the cylinders 34 each include at least one direct injector 76 for delivering fuel to the combustion chamber 74 thereof from a liquid fuel source, such as second fuel source 104. In addition, at least one or a port injector at each cylinder or a mixer at an inlet of compressor 44 can be provided for delivery or induction of fuel from the first fuel source 102 with the charge flow delivered to cylinders 34.

A direct injector, as utilized herein, includes any fuel injection device that injects fuel directly into the cylinder volume (combustion chamber), and is capable of delivering fuel into the cylinder volume when the intake valve(s) and exhaust valve(s) are closed. The direct injector may be structured to inject fuel at the top of the cylinder or laterally of the cylinder. In certain embodiments, the direct injector may be structured to inject fuel into a combustion pre-chamber. Each cylinder 34, such as the illustrated cylinders 34 in FIG. 2, may include one or more direct injectors 76 in the duel fuel engine embodiment. The direct injectors 76 may be the primary fueling device for liquid fuel source 104 for the cylinders 34.

A port injector, as utilized herein, includes any fuel injection device that injects fuel outside the engine cylinder in the intake manifold to form the air-fuel mixture. The port injector injects the fuel towards the intake valve. During the intake stroke, the downwards moving piston draws in the air/fuel mixture past the open intake valve and into the combustion chamber. Each cylinder 34 may include one or more port injectors (not shown). In one embodiment, the port injectors may be the primary fueling device for first fuel source 102 to the cylinders 34. In another embodiment, the first fuel source 102 can be connected to intake system 22 with a mixer upstream of intake manifold 28, such as at the inlet or upstream of compressor 44.

In certain dual fuel embodiments, each cylinder 34 includes at least one direct injector that is capable of providing all of the designed primary fueling amount from liquid fuel source 104 for the cylinders 34 at any operating condition. First fuel source 102 provides a flow of a gaseous fuel to each cylinder 34 through a port injector or a natural gas connection upstream of intake manifold 28 to provide a second fuel flow (in the dual fuel embodiment) or the sole fuel flow (in a single fuel source embodiment) to the cylinders 34 to achieve desired operational outcomes.

In the dual fuel embodiment, the fueling from the second, liquid fuel source 104 is controlled to provide the sole fueling at certain operating conditions of engine 30, and fueling from the first fuel source 102 is provided to substitute for fueling from the second fuel source 104 at other operating conditions to provide a dual flow of fuel to engine 30. In the dual fuel embodiments where the first fuel source 102 is a gaseous fuel and the second fuel source 104 is a liquid fuel, a control system including controller 100 is configured to control the flow of liquid fuel from second fuel source 104 and the flow of gaseous fuel from first fuel source 102 in accordance with engine speed, engine loads, intake manifold pressures, and fuel pressures, for example. In single fuel embodiments where the sole fuel source 102 is a gaseous fuel, a control system including controller 100 is configured to control the flow of gaseous fuel from first fuel source 102 in accordance with engine speed, engine loads, intake manifold pressures, and fuel pressures, for example. In single fuel embodiments where the sole fuel source 104 is a liquid fuel, a control system including controller 100 is configured to control the flow of liquid fuel from second fuel source 104 in accordance with engine speed, engine loads, intake manifold pressures, and fuel pressures, for example.

One embodiment of system 20 shown in FIG. 2 includes each of the cylinders 34 with a direct injector 76 (in dual fuel embodiment) and/or a spark plug 80, associated with each of the illustrated cylinders 34*a*-34*f* of FIG. 1. Direct injectors 76 are electrically connected with controller 100 to receive fueling commands that provide a fuel flow to the respective cylinder 34 in accordance with a fuel command determined according to engine operating conditions and operator demand by reference to fueling maps, control algorithms, or other fueling rate/amount determination source stored in controller 100. Spark plugs 80 are electrically connected with controller 100 to receive spark or firing commands that provide a spark in the respective cylinder 34 in accordance with a spark timing command determined according to engine operating conditions and operator demand by reference to fueling maps, control algorithms, or other fueling rate/amount determination source stored in controller 100.

Each of the direct injectors 76 can be connected to a fuel pump (not shown) that is controllable and operable to provide a flow or fuel from second fuel source 104 to each of the cylinders 34 in a rate, amount and timing determined by controller 100 that achieves a desired torque and exhaust output from cylinders 34. The fuel flow from first fuel source 102 can be provided to an inlet of compressor 44 or to port injector(s) upstream of cylinders 34. A shutoff valve 82 can be provided in fuel line 108 and/or at one or more other locations in fuel system 21 that is connected to controller 100. The gaseous fuel flow is provided from first fuel source 102 in an amount determined by controller 100 that achieves a desired torque and exhaust output from cylinders 34.

Controller 100 can be connected to actuators, switches, or other devices associated with fuel pump(s), shutoff valve 82, intake throttle 58, waste gate 48 or an inlet to a VGT or an exhaust throttle, spark plugs 80, and/or injectors 76 and configured to provide control commands thereto that regulate the amount, timing and duration of the flows of the gaseous and/or liquid fuels to cylinders 34, the charge flow, and the exhaust flow to provide the desired torque and exhaust output in response to an estimated NOx amount based at least in part on the measured exhaust manifold pressure and a predetermined engine out NOx limit.

In addition, controller 100 can be connected to physical and/or virtual engine sensor(s) 90 to detect, measure and/or estimate one or more engine operating conditions outside of cylinders 34 such as charge pressure, IMT, IMP, mass charge flow (MCF), EGR flow, an oxygen amount or lambda in the exhaust, engine speed, engine torque, spark timing, waste gate or turbine inlet position, and other operating conditions. An EMP sensor 98 can measure exhaust manifold pressure during engine operation. Controller 100 can be connected to a charge pressure sensor 97 to detect or measure a pressure in the charge flow during engine operation.

As discussed above, the positioning of each of the actuators, switches, or other devices associated with fuel pump(s), shutoff valve 82, intake throttle 58, waste gate 48 or an inlet to a VGT or an exhaust throttle, spark plug(s) 80, injector(s) 76, intake and/or intake valve opening mechanisms, cam phasers, etc. can be controlled via control commands from controller 100. In certain embodiments of the systems disclosed herein, controller 100 is structured to perform certain operations to control engine operations and fueling of cylinders 34 with fueling system 21 to provide the desired engine speed, torque outputs, spark timing, lambda, and other outputs or adjustments in response to the exhaust manifold pressure measurement from EMP sensor 98.

In certain embodiments, the controller 100 forms a portion of a processing subsystem including one or more computing devices having memory, processing, and communication hardware. The controller 100 may be a single device or a distributed device, and the functions of the controller 100 may be performed by hardware or software. The controller 100 may be included within, partially included within, or completely separated from an engine controller (not shown). The controller 100 is in communication with any sensor or actuator throughout the systems disclosed herein, including through direct communication, communication over a datalink, and/or through communication with other controllers or portions of the processing subsystem that provide sensor and/or actuator information to the controller 100.

The controller 100 includes stored data values, constants, and functions, as well as operating instructions stored on computer readable medium. Any of the operations of exemplary procedures described herein may be performed at least partially by the controller. Other groupings that execute similar overall operations are understood within the scope of the present application. Modules may be implemented in hardware and/or on one or more computer readable media, and modules may be distributed across various hardware or computer implemented. More specific descriptions of certain embodiments of controller operations are discussed herein in connection with FIGS. 3 and 4. Operations illustrated are understood to be exemplary only, and operations may be combined or divided, and added or removed, as well as re-ordered in whole or in part.

Certain operations described herein include operations to interpret or determine one or more parameters. Interpreting or determining, as utilized herein, includes receiving values by any method, including at least receiving values from a datalink or network communication, receiving an electronic signal (e.g., a voltage, frequency, current, or pulse-width modulation (PWM) signal) indicative of the value, receiving a software parameter indicative of the value, reading the value from a memory location on a computer readable medium, receiving the value as a run-time parameter by any means known in the art, and/or by receiving a value by which the interpreted or determined parameter can be calculated, and/or by referencing a default value that is interpreted or determined to be the parameter value.

Figure 3:
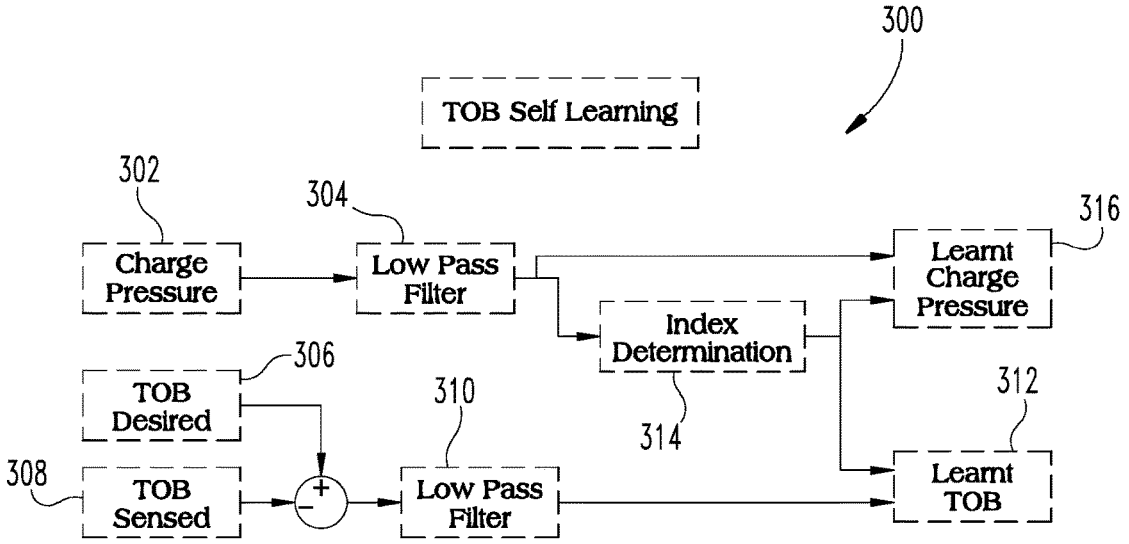
FIG. 3 is a diagram of an example control logic for learning a TOB offset for controlling operation of the internal combustion engine.
Figure 4:
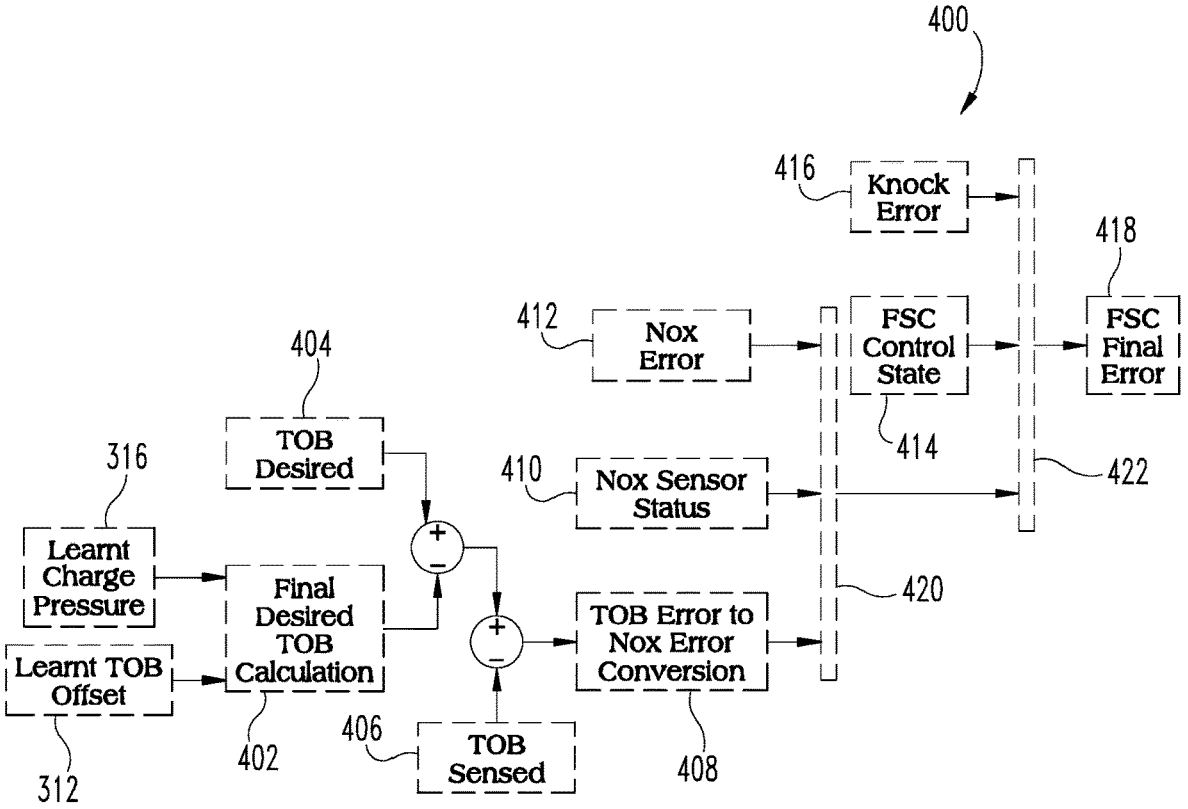
FIG. 4 is a diagram of an example control logic for integrating the learned TOB offset in a combustion control algorithm.

In one embodiment, controller 100 is configured to perform operations such as shown in FIGS. 3 and 4 for real-time learning and updating of a TOB reference used in the control and operation of engine 30 based on the virtual NOx sensor measurements provided by TOB. In one embodiment, the updated TOB reference is an updated TOB error that is used as a virtual sensor for NOx error for combustion control of engine 30 when NOx sensor(s) 47, 47' have failed or are not active. Learning of the TOB reference reduces effort in tuning and calibrating TOB to the specific engine attributes and operating conditions, and facilitates integration of TOB into the combustion control algorithm for engine 30.

Engine out NOx concentration is directly correlated to adiabatic flame temperature (AFT), which is the temperature of complete combustion products in the constant volume combustion process without doing work, no heat transfer, or changes in kinetic or potential energy. One type of combustion control algorithm is a flame speed compensator, which is a closed loop combustion control algorithm that uses engine out NOx or an average knock index as feedback to control operation of the spark ignition engine 30. The flame speed compensator control algorithm actively switches closed loop control feedback between knock and NOx based on the knock and NOx error. When the NOx sensor(s) 47, 47' fail or are not active, the NOx error in the control algorithm is replaced by the updated TOB error determined according to the logic and procedures disclosed herein.

Referring to FIG. 3, a control logic diagram 300 for TOB self-learning is illustrated. TOB has a strong correlation with engine out NOx, but does not have a one-to-one relationship at different operating conditions, and TOB is sensitive to engine part-to-part variation. Diagram 300 includes a first input 302 for a charge pressure of a charge flow to one of more of the cylinders 34 of engine 30. The charge pressure inputs 302 are processed in a low pass filter 304. In the illustrated embodiment, charge pressure is used to represent engine load, and a filtered charge pressure value is used to indicate the engine load at which the TOB is learned. However, the use of other operating parameters to indicate the condition at which the TOB is learned is not precluded.

Diagram 300 also includes a desired TOB input 306 and a sensed TOB input 308, and the difference between these inputs is determined as a TOB error and passed through low pass filter 310. When the engine is at steady state, the sensed TOB identifies an appropriate combustion condition. The desired TOB is tuned in a test cell environment for nominal operating conditions. The error between the desired TOB and sensed TOB is the TOB error that is filtered and learned as the learned TOB offset 312 at a measured engine load condition indicated by the learned charge pressure 316.

An index determination block 314 receives the filtered charge pressure from low pass filter 304 as an input, and outputs an array index to determine the learned TOB offset 312 and the learned charge pressure 316. In one embodiment, the index determination is a two-dimensional look-up table. Based on the index determined by the input charge pressure at block 314, the learned TOB offset 312 and learned charge pressure 316 are stored in an appropriate array index. The learned TOB offsets 312 are thus identified at varying load conditions and other associated operating conditions (e.g. fuel quality, humidity, altitude, exhaust back pressure, spark timing, air/fuel ratio and/or any other captured conditions) at that load condition, and the learned TOB offsets 312 and the learned charge pressure 316 are stored in a memory of the controller 100 as a power down save.

Referring to FIG. 4, there is shown control logic diagram 400 that captures the integration of the learned TOB offset 312 in the combustion control algorithm, such as a flame speed compensator (FSC). The learned TOB offset 312 and learned charge pressure 316 are provided to a calculator 402 that determines a learned final desired TOB at a given operating condition. The learned final desired TOB at calculator 402 can be found by interpolating between the learned charge pressure breakpoints in the learning algorithm.

The updated learned TOB error provided to block 408 is determined by subtracting the learned final desired TOB determined by calculator 402 from the desired TOB input 404, and then subtracting this difference from the sensed TOB input 406. Since the units of TOB are different than NOx, a loop gain multiplier is used to convert the updated learned TOB error to a NOx error at block 408.

The output from block 408, along with the NOx sensor status from block 410 and NOx error from block 412, are provided to an evaluation block 420. Under conditions in which the NOx sensors are inoperable or inactive, the NOx error conversion based on the learned TOB error is provided as an input to the combustion control algorithm 422. The combustion control algorithm 422 determines a combustion control error 418 based on the NOx error from either the NOx sensor(s) or updated TOB error if the NOx sensor(s) are inactive or disabled, the control state 414 of the algorithm, and the knock error 416. The final error 418 can be used by an engine control module of controller 100 to output an operating lever adjustment command to meet or maintain an engine operating performance target and/or emissions target.

The adjustment in the one or more operating conditions and/or operating lever adjustment includes, for example, adjusting at least one operating lever of system 20 associated with one or more of the lambda and spark timing in order to deliver one or more of a target engine out NOx amount, a target knock margin, a target brake thermal energy (BTE), and/or a target coefficient of variance for the GIMEP. Levers of system 20 that effect the engine out NOx amount and that can be controlled in response to the estimated engine out NOx amount to meet a NOx target include one or more of IMT, humidity, spark timing, coolant temperature, compression ratio, intake/exhaust valve timing (opening and closing), swirl, lambda, air-fuel ratio, water injection, steam injection and membranes, for example.

Possible levers of system 20 that can be adjusted to meet emissions or other performance targets may include, for example, valves, pumps and/or other actuators that control a fuel flow to cylinders 34 and/or an air flow to cylinders 34. Further example levers include an intake air throttle position, a waste gate position, a turbine inlet opening size, a compressor bypass, variable valve actuator, a cam phaser, a variable valve timing, switching between multiple lift profiles/cams, compression braking, Miller cycling (early and/or late intake valve closing), cylinder bank cutout, cylinder cutout, intermittent cylinder deactivation, exhaust throttle, spark timing, IMT regulation, changing displacement of engine, changing number of strokes in cycle (e.g. 2 stroke vs. 4 stroke), pressure relief valve venting in the intake and/or exhaust, bypassing one or more of the compressors or turbines in a single stage turbocharger system or two stage turbocharger system or in a multiple turbine system, switching turbines in and out, and activating electrically activated turbocharging/supercharging, power-turbine (coupled to crank or alternator), turbo-compounding, exhaust throttle control downstream of one or more of the turbines, and EGR flow from one or more of a dedicated EGR, high pressure EGR loop, low pressure EGR loop, and internal EGR.

Various aspects of the systems and methods disclosed herein are contemplated, including those in the claims appended hereto and in the discussion above. For example, one aspect is directed to a method including: determining a pressure in a charge flow to at least one of a plurality of cylinders of an internal combustion engine system; determining a TOB error associated with the pressure in the charge flow; learning a TOB offset and a charge pressure at the associated pressure in the charge flow; determining an updated TOB error in response to the learned TOB offset, a desired TOB, and a sensed TOB; and adjusting an operating condition of the at least one engine in response to the updated TOB error.

In an embodiment, the internal combustion engine system includes an intake system connected to the plurality of cylinders and at least one fuel source operably connected to the internal combustion engine system to provide a flow of fuel to each of the plurality of cylinders. The intake system is coupled to each of the plurality of cylinders to provide the charge flow from the intake system to a combustion chamber of the respective cylinder. The internal combustion engine system further includes an exhaust manifold connected to an exhaust system. In one refinement of this embodiment, the exhaust system includes first and second exhaust conduits connected to respective ones of first and second exhaust conduits of the exhaust system. In a further refinement, the first and second exhaust conduits include respective ones of first and second exhaust sensors. In yet a further refinement, the first and second NOx sensors are failed or not active.

In another embodiment of the method, learning the TOB offset and the charge pressure includes applying an index value to the TOB error that is based on the pressure in the charge flow. In one refinement, the method includes storing the learned TOB offset and the learned charge pressure in an array index of a look-up table. In a further refinement, the method includes associating one or more engine operating conditions with the learned TOB offset at the learned charge pressure. In yet a further refinement, the one or more operating conditions include one or more of fuel quality, humidity, altitude, exhaust back pressure, spark timing, and air/fuel ratio.

In another embodiment, the pressure in the charge flow is indicative of an engine load. In yet another embodiment, the TOB error is determined in response to a difference between a desired TOB and a second TOB. In still another embodiment, the method includes converting the updated TOB error to a NOx error.

According to another aspect, a system includes an internal combustion engine including a plurality of cylinders and at least one engine sensor, an exhaust system configured to receive exhaust from the plurality of cylinders, and an intake system configured to direct a charge flow to the plurality of cylinders. The system also includes a fuel system including at least one fuel source operable to provide a flow of fuel to the plurality of cylinders and a controller connected to the internal combustion engine and the at least one engine sensor. The controller is configured to receive a pressure signal indicative of the charge flow pressure and determine a TOB error associated with the charge flow pressure, learn a TOB offset and learn a charge pressure at the associated charge flow pressure, determine an updated TOB error in response to the learned TOB offset, a desired TOB, and a sensed TOB, and adjust an operating condition of the internal combustion engine in response to the updated TOB error.

In one embodiment, the fuel is selected from the group consisting of natural gas, bio-gas, methane, propane, ethanol, producer gas, field gas, liquefied natural gas, compressed natural gas, or landfill gas. In another embodiment, the controller is configured to adjust at least one of the following in response to the engine out NOx amount: a spark timing in the at least one cylinder in response to the engine out NOx amount; and a lambda in the at least one cylinder in response to the engine out NOx amount.

According to yet another aspect, an apparatus includes an electronic controller. The controller is operable to: determine a pressure in a charge flow to at least one of a plurality of cylinders of an internal combustion engine system; determine a TOB error associated with the pressure in the charge flow; learn a TOB offset and a charge pressure at the associated pressure in the charge flow; determine an updated TOB error in response to the learned TOB offset, a desired TOB, and a sensed TOB; and adjust an operating condition of the at least one engine in response to the updated TOB error.

In one embodiment, the controller is configured to: learn the TOB offset and the charge pressure at the associated pressure by applying an index value to the TOB error that is based on the pressure in the charge flow; store the learned TOB offset and the learned charge pressure in an array index of a look-up table; and associate one or more engine operating conditions with the learned TOB offset at the learned charge pressure.

In another embodiment, the pressure in the charge flow is indicative of an engine load. In still another embodiment, the TOB error is determined in response to a difference between a desired TOB and a second TOB. In yet another embodiment, the controller is configured to convert the updated TOB error to a NOx error.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A method, comprising:

determining a pressure in a charge flow to at least one of a plurality of cylinders of an internal combustion engine system;

determining a torque over boost (TOB) error associated with the pressure in the charge flow;

learning a TOB offset and a charge pressure at the associated pressure in the charge flow;

determining an updated TOB error in response to the learned TOB offset, a desired TOB, and a sensed TOB; and adjusting an operating condition of the at least one engine in response to the updated TOB error.

2. The method of claim 1, wherein the internal combustion engine system includes an intake system connected to the plurality of cylinders and at least one fuel source operably connected to the internal combustion engine system to provide a flow of fuel to each of the plurality of cylinders, wherein the intake system is coupled to each of the plurality of cylinders to provide the charge flow from the intake system to a combustion chamber of the respective cylinder, the internal combustion engine system further including an exhaust manifold connected to an exhaust system.

3. The method of claim 2, wherein the exhaust system includes first and second exhaust conduits connected to respective ones of first and second exhaust conduits of the exhaust system.

4. The method of claim 3, wherein the first and second exhaust conduits include respective ones of first and second exhaust sensors.

5. The method of claim 4, wherein the first and second exhaust sensors are failed or not active.

6. The method of claim 1, wherein learning the TOB offset and the charge pressure includes applying an index value to the TOB error that is based on the pressure in the charge flow.

7. The method of claim 6, further comprising storing the learned TOB offset and the learned charge pressure in an array index of a look-up table.

8. The method of claim 7, further comprising associating one or more engine operating conditions with the learned TOB offset at the learned charge pressure.

9. The method of claim 8, wherein the one or more operating conditions include one or more of fuel quality, humidity, altitude, exhaust back pressure, spark timing, and air/fuel ratio.

10. The method of claim 1, wherein the pressure in the charge flow is indicative of an engine load.

11. The method of claim 1, wherein the TOB error is determined in response to a difference between the desired TOB and the sensed TOB.

12. The method of claim 1, further comprising converting the updated TOB error to a NOx error.

13. A system, comprising:

an internal combustion engine including a plurality of cylinders and at least one engine sensor;

an exhaust system configured to receive exhaust from the plurality of cylinders;

an intake system configured to direct a charge flow to the plurality of cylinders;

a fuel system including at least one fuel source operable to provide a flow of fuel to the plurality of cylinders; and a controller connected to the internal combustion engine and the at least one engine sensor, wherein the controller is configured to:

receive a pressure signal indicative of the charge flow pressure and determine a torque over boost (TOB) error associated with the charge flow pressure;

learn a TOB offset and learn a charge pressure at the associated charge flow pressure;

determine an updated TOB error in response to the learned TOB offset, a desired TOB, and a sensed TOB; and adjust an operating condition of the internal combustion engine in response to the updated TOB error.

14. The system of claim 13, wherein the fuel is selected from the group consisting of natural gas, bio-gas, methane, propane, ethanol, producer gas, field gas, liquefied natural gas, compressed natural gas, or landfill gas.

15. The system of claim 13, wherein the controller is configured to adjust at least one of the following in response to the engine out NOx amount:

a spark timing in the at least one cylinder in response to the engine out NOx amount; and a lambda in the at least one cylinder in response to the engine out NOx amount.

16. An apparatus, comprising:

an electronic controller operable to:

determine a pressure in a charge flow to at least one of a plurality of cylinders of an internal combustion engine system;

determine a torque over boost (TOB) error associated with the pressure in the charge flow;

learn a TOB offset and a charge pressure at the associated pressure in the charge flow;

determine an updated TOB error in response to the learned TOB offset, a desired TOB, and a sensed TOB; and adjust an operating condition of the at least one engine in response to the updated TOB error.

17. The apparatus of claim 16, wherein the controller is configured to:

learn the TOB offset and the charge pressure at the associated pressure by applying an index value to the TOB error that is based on the pressure in the charge flow;

store the learned TOB offset and the learned charge pressure in an array index of a look-up table; and associate one or more engine operating conditions with the learned TOB offset at the learned charge pressure.

18. The apparatus of claim 16, wherein the pressure in the charge flow is indicative of an engine load.

19. The apparatus of claim 16, wherein the TOB error is determined in response to a difference between a desired TOB and a second TOB.

20. The apparatus of claim 16, wherein the controller is configured to convert the updated TOB error to a NOx error.

* * * * *